US005269909A

United States Patent [19]

Ovalles et al.

[11] Patent Number: 5,269,909

[45] Date of Patent: Dec. 14, 1993

[54] PROCESS FOR TREATING HEAVY CRUDE OIL

[75] Inventors: Cesar Ovalles; Antonia Hamana; Rafael Bolivar, all of Caracas, Venezuela; Alfredo Morales, Arcadia, Calif.

[73] Assignee: Intevep, S.A., Caracas, Venezuela

[21] Appl. No.: 783,788

[22] Filed: Oct. 29, 1991

[51] Int. Cl.[5] ..... C10G 5/00

[52] U.S. Cl. ..... 208/370; 208/125; 208/13; 208/108; 208/113

[58] Field of Search ..... 208/421, 431, 370, 13

[56] References Cited

U.S. PATENT DOCUMENTS

| | | | |
|---|---|---|---|
| 4,493,761 | 1/1985 | Hensley | 208/421 |
| 4,687,570 | 8/1987 | Sundaram et al. | 208/433 |
| 5,069,775 | 12/1991 | Grosboll | 208/14 |
| 5,110,452 | 5/1992 | Meyer et al. | 208/431 |
| 5,120,430 | 6/1992 | Morgan | 208/431 |

*Primary Examiner*—Helane Myers

*Attorney, Agent, or Firm*—Bachman & LaPointe

[57] ABSTRACT

Process obtains improved viscosity and improved distillates proportion in heavy hydrocarbons, as heavy crude oil, by providing a feedstock of heavy hydrocarbons containing a water content of greater than or equal to 1% with respect to the weight of the hydrocarbons and reacting said hydrocarbons with a gas containing methane under pressure and at an elevated temperature.

15 Claims, 2 Drawing Sheets

PROCESS FOR TREATING HEAVY CRUDE OIL

BACKGROUND OF THE INVENTION

The present invention relates to a process for obtaining improved viscosity and improved distillate proportion in a heavy hydrocarbon, such as heavy or extra heavy crude oil.

It is highly desirable to improve the properties of heavy crude oil especially to substantially reduce their viscosity and increase their distillates proportion due to the large availability of heavy crude oil, for example, in the petroleum Orinoco belt. It is highly desirable to improve the properties of heavy crude oil in a commercially viable process in order to provide a good alternative source of practical petroleum based products.

Various processes are known for treating hydrocarbon materials using hydrogen, methane and nitrogen in order to improve the properties thereof. However, these processes are not entirely satisfactory on a commercial scale or suffer from various disadvantages. It is particularly desirable to utilize methane in view of its ready availability as natural gas and relative low cost as compared for example to hydrogen.

U.S. Pat. No. 4,687,570 accomplishes the liquefaction of carbonaceous materials particularly coal in a pressurized methane atmosphere. However, methane conversion was higher than found for nitrogen but lower than that found for hydrogen. Therefore, the main problem in the use of methane is its low reactivity. Catalytic reaction improves the reactivity somewhat, but involves the use of an expensive catalyst and it would still be desirable to further improve the process.

Accordingly, it is a principal object of the present invention to provide a process for obtaining improved viscosity and improved distillates proportion in heavy crude oil by reacting the crude with a gas containing methane.

It is a particular object of the present invention to obtain petroleum by products of a higher added value from heavy oils, bitumens and residues utilizing inexpensive methane as a raw material.

It is a further object of the present invention to provide a process as aforesaid obtaining reduced viscosity from heavy hydrocarbons in order to facilitate their transportation and use by conventional methods.

It is a further object of the present invention to provide a process as aforesaid which is suitable for use with a methane activation catalyst in the reaction medium.

Further objects and advantages of the present invention will appear hereinbelow.

SUMMARY OF THE INVENTION

In accordance with the present invention, it has now been found that the foregoing objects and advantages may be readily obtained.

The process of the present invention obtains improved viscosity and improved distillate proportion in heavy hydrocarbons which comprises: providing a feedstock of heavy hydrocarbons preferably having an API gravity at 60° F. of less than 20°, wherein said hydrocarbon contains a water content of greater than or equal to 1% with respect to the weight of the hydrocarbon; reacting said hydrocarbon with a gas containing methane with a methane content of at least 50%, wherein the ratio of gas to crude is from 0.1 to 500 parts by volume, and wherein the reaction takes place under the following conditions: 1) at a temperature of at least 250° C.; 2) under pressure of up to 6000 psi; and 3) at a reaction time of at least 30 minutes; and separating the resultant liquid hydrocarbons.

The preferred starting material is heavy crude oil. The preferred methane starting material is natural gas. The reaction temperature is preferably at from 380° to 420° C. and the reaction should be carried out under pressure of at least 100 psi. Improvement is obtained when the reaction between the crude and the methane is carried out in the presence of a catalyst.

In accordance with the present invention, significant improvements in the resultant product are obtained. Significant improvement in viscosity is obtained and the distillates percentage of over 60% is readily obtained. In addition, products with a high commercial value are obtained, such as gasoline, light naphta, heavy oil, kerosine, gasoil, lubricants and others.

Further advantages and features of the present invention will appear hereinbelow.

BRIEF DESCRIPTION OF THE DRAWINGS

The present invention will be more readily understood from a consideration of the following illustrative examples wherein.

DETAILED DESCRIPTION

Figure 1:
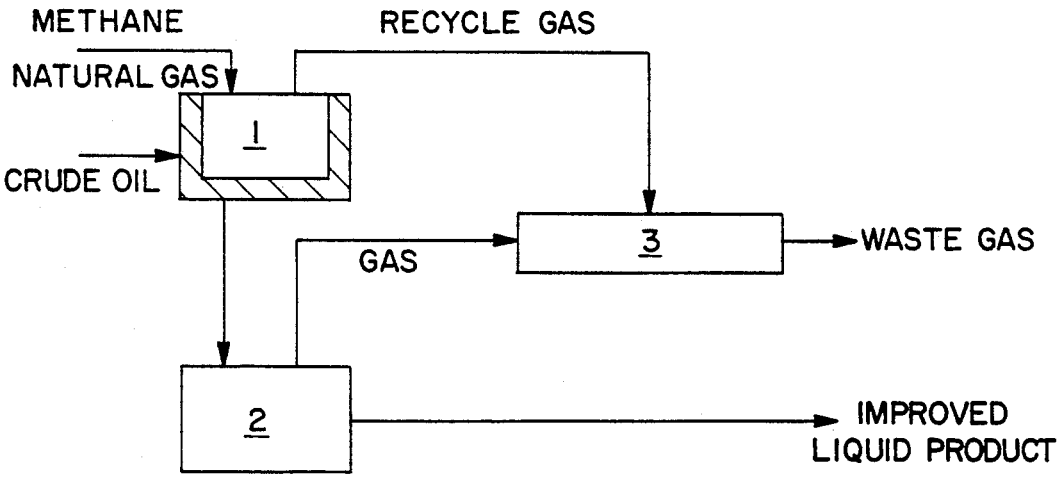
FIG. 1 is a block diagram illustrating the process of the present invention.

The process of the present invention obtains improved viscosity and improved distillates proportion from heavy hydrocarbons. As used in the present specification, the term "heavy hydrocarbons" means heavy or extra heavy crude oil, bitumens and residues and the present process applies to all these materials. The API gravity of the heavy hydrocarbons should be less than 20° at 60° F. In the preferred embodiment, heavy or extra heavy crude oil from the Orinoco belt is used. This material is characterized by its high API gravity, high pour points, high viscosity and high content of sulfur, metals, salts and Conradson carbon. Typical properties are set out in Table I below.

TABLE I

| | |
|---|---|
| Specific gravity at 15° C. | 0.9390–1.0639 |
| API Gravity at 60° F. | 1.5–19.0 |
| Dynamic Viscosity | 500–1.000.000 |
| Pour point | −20:153 |
| Flash point | 112–306 |
| Water and sediments (% vol) | 0.4–65.7 |
| Sodium chloride (pounds/1000 BBLS) | 4.8–1003 |
| Sulphur (% p/p) | 2.09–3.80 |
| Vanadium (ppm) | 220.14–1106 |
| Nickel | 45.5–161.9 |
| Asphaltene (% w/w) | 6.95–22.69 |

In accordance with the present invention, the water content of the heavy hydrocarbon starting material should be maintained greater than or equal to 1% with respect to the weight of the hydrocarbon. As will be apparent from the data, significant and surprising advantages are obtained in the process of the present invention when the water content is maintained as aforesaid.

The methane containing gas is preferably natural gas. Naturally, the natural gas can be enriched with methane or pure methane may be utilized as a starting material. The methane containing gas should include at least 50% methane and the ratio of gas to crude should be from 0.1 to 500 parts by volume.

The reaction between the methane containing gas and heavy hydrocarbon takes place under pressure at an elevated temperature and at a reaction time of at least 30 minutes. The reaction temperature should be at least 250° C. and preferably from 380° to 420° C. The reaction pressure should be at a pressure of at least 100 psi and up to 6000 psi. The reaction time should be at least 30 minutes and generally less than 10 hours, although the upper limit for reaction time is naturally dependent upon operating conditions.

Additional improvement is obtained when the reaction takes place in the presence of a catalyst. The catalyst is preferably a mixture of: A) A transition element selected from the group consisting of the members of Group VI of the Periodic Table; B) A transition element selected from the group consisting of the members of Group VIII of the Periodic Table; C) A compound based on phosphorous; A) B) and C) being supported upon alumina or silica. Element A is preferably molybdenum and it is preferred that the catalyst includes molybdenum oxide in proportions ranging from 5 to 30% with respect to the total weight of the catalyst. Element B is preferably nickel and it is preferred that the catalyst includes nickel oxide in proportions of 5 to 30% with respect to total weight of the catalyst.

Referring to FIG. 1, it can be seen that the crude oil and methane containing gas are fed to reactor 1 where the reaction takes place. The resultant product after reaction is fed to a gas-liquid separator 2 where the improved liquid product is removed therefrom and the gas is sent to a gas purification unit 3. Recycled gas from reactor 1 is also sent to the gas purification unit. Waste gas is removed from the gas purification unit.

The features of the present invention will be more clearly understood from the following illustrative examples.

EXAMPLE 1

The reactor was loaded with a 40 grs Hamaca crude oil with the physical and chemical properties shown in Table II, below and was pressurized with methane up to a pressure of 680 psi at atmospheric temperature. The relation methane/crude was of 5:1. Then, the reaction mixture was heated to 380° C. under pressure up to 1800 psi, leaving the reaction running for five hours under these conditions. Successively, the reactor was cooled down and the resultant liquid product was separated therefrom. The API gravity of the product measured at 60° F. was of 12.5 and the viscosity at 30° C. was of 1990 centipoises. The same liquid product was subjected to a distillation and the distillates fraction under 540° C. was of a 73.5%.

TABLE II

| | |
|---|---|
| API Gravity at 60° F. | 8.6 |
| Water (% p/p) | 4.4 |
| Asphaltenes (% p/p) | 12.5 |
| Sulphur (% p/p) | 3.75 |
| Nickel (ppm) | 91.9 |
| Vanadium (ppm) | 412 |
| Dynamic Viscosity at 22° C. (cP | 500,000 |

EXAMPLE 2

The same process as the one of the previous example was carried out here, the only difference is the relation methane/crude which was of 2.75:1.

The API Gravity of the product measured at 60° F. was of 10.0 and the viscosity at 30° C. was of 3160 centipoises. The distillated fraction under 540° C. was of 62.0%. As it can be observed from the results obtained in the Examples 1 and 2, the viscosities of the final product in both cases have been substantially reduced, which demonstrates that the original crude oil has been substantially improved with the methane treatment.

EXAMPLE 3

The same procedure as in the Example 1 was carried out, but hydrogen and nitrogen were used separately as gases. The relation gas/crude was of 5:1 in both cases. For the product obtained from the treatment with hydrogen and nitrogen respectively, the results are as follows:

API (60° F.), 12,2; viscosity (30° C.), 1600 cP; distillates at 540° C., 73.1—hydrogen treatment API (60° F.), 11.4; viscosity (30° C.), 2620 cP; distillates at 540° C., 71%—nitrogen treatment Therefore, it can be seen that the methane treatment, applied to said crude oil under the given reaction conditions, improves the original physical properties of same.

On the other hand, if the results of Example 3 are compared to the results of Examples 1 and 2, it can be seen that the methane treatment competes favorably with the reactions under hydrogen or nitrogen.

EXAMPLE 4

As in the previous examples, the same Hamaca crude was used. The process was carried out here employing separately methane, hydrogen and nitrogen, leaving the relation gas/crude of 5:1 under the same pressure and temperature conditions as in the Example 1 (380° C. and 1600 psi). This time each run was made in the presence of a nickel-molybdenum catalyst supported over alumina as specified in Table III.

TABLE III

| | |
|---|---|
| $MoO_3$ (% p) | 5-30 |
| NiO (% p) | 0.1-8.0 |
| $P_2O_5$ (% p) | 5-30 |
| Surface area ($m^2/g$) | 120-400 |
| Pore total volume (cc/g) | 0.5-1.2 |
| Pore medium diameter (Å) | 90-300 |
| Extrudated size (inches) | 1/32-1/16 |

The API Gravity values, viscosity and distillates percentage for the three gases are summarized in Table IV.

TABLE IV

| | $CH_4$ | $H_2$ | $N_2$ |
|---|---|---|---|
| °API (60° F.) | 14.2 | 17.5 | 11.9 |
| Viscosity (cP) (30° C.) | 1440 | 581 | 2130 |
| Distillates 540° C. (%) | 64.7 | 64 | 65.2 |

The results obtained in the presence of hydrogen and catalyst represent a substantial improvement in comparison with the same process in the presence of hydrogen but without a catalyst. The same effect is obtained in the case of the runs with and without catalyst, but utilizing methane as reactive gas. On the contrary, if the reactions are carried out under nitrogen inert atmosphere, there is basically no difference with the use or not of a catalyst.

Figure 2:
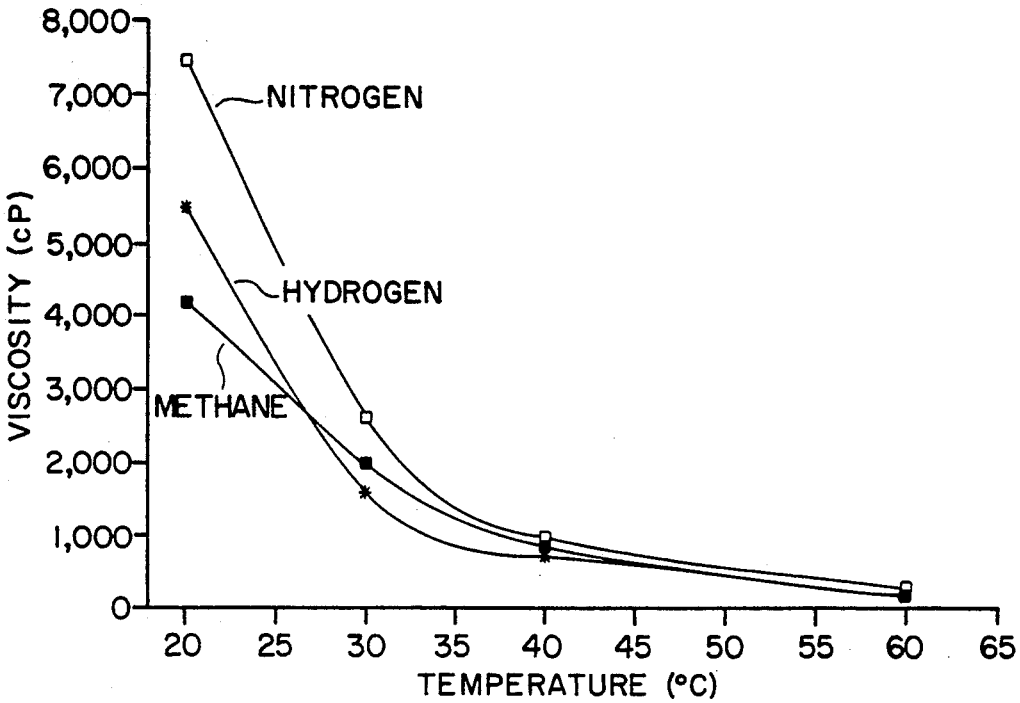
FIG. 2 is a viscosity graph vs. product temperature comparing nitrogen, hydrogen and methane without a catalyst.
Figure 3:
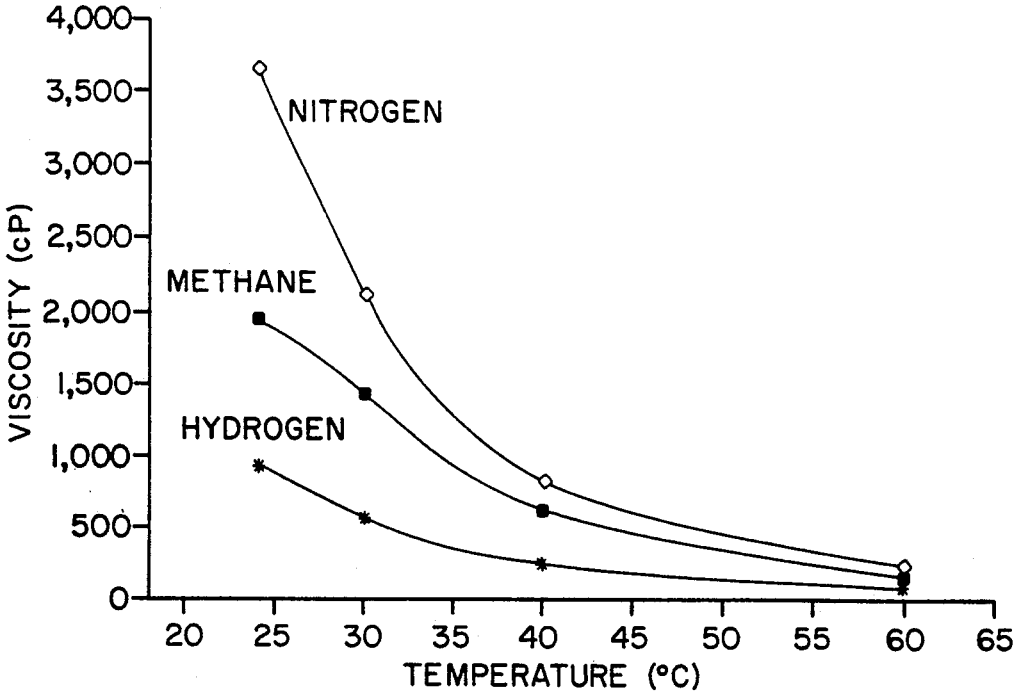
FIG. 3 is a viscosity graph vs. product temperature comparing methane, nitrogen and hydrogen in the presence of a catalyst.

Also, the viscosity behavior of the liquids obtained with respect to the temperature in the reactions, is shown in the graphs given in FIGS. 2 and 3. Thus, the invention process, that is to say, the natural gas crude treatment, can favorably compete with standard hydrotreatment.

EXAMPLE 5

Here, the Hamaca crude sample was previously dehydrated (water content less than 0.1%). The procedure was the same as in Example 1. The product obtained showed the following properties: 10.5 API (60° F.); viscosity (30° C.) of 2400 cP and distillates of 540° C. at 73.5%.

Comparing Example 5 with the results of Example 1, it can be readily seen that the water content achieves a significant and surprising advantage It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Process for obtaining improved viscosity and improved distillate proportion in heavy hydrocarbons which comprises:

providing a feedstock of heavy hydrocarbon containing a water content of greater than or equal to 1% with respect to the weight of the hydrocarbon;

reacting said hydrocarbon with a gas containing methane with a methane content of at least 50%, wherein the ratio of gas to crude is from 0.1 to 500 parts by volume, and where the reaction takes place under the following conditions: at a temperature of at least 250° C.; under pressure of up to 6000 psi; and with a reaction time of at least 30 minutes; and separating the resultant liquid hydrocarbons.

2. Process according to claim 1 including the step of providing a heavy hydrocarbon with an API Gravity of less than 20° at 60° F.

3. Process according to claim 2 wherein the heavy hydrocarbon is heavy crude oil having the following characteristics:

| | |
|---|---|
| Specific Gravity at 15° C. | 0.9390–1.0639 |
| API Gravity at 60° F. | 1.5–19.0 |
| Dynamic Viscosity at 22° C. (cP) | 500–1.000.000 |
| Pour point (°F.) | −20:153 |
| Flash Point (°F.) | 112–306 |

4. Process according to claim 2 wherein said gas containing methane is natural gas.

5. Process according to claim 2 wherein the resultant distillates percentage is over 60%.

6. Process according to claim 2 wherein the reaction temperature is between 380° to 420° C.

7. Process according to claim 2 wherein the reaction takes places at a pressure greater than 100 psi.

8. Process according to claim 2 wherein the reaction is carried out in the presence of a catalyst.

9. Process according to claim 8 wherein the catalyst is a mixture of: A) A transition element selected from the group consisting of the members of Group VI of the Periodic Table; B) A transition element selected from the group consisting of the members of Group VIII of the Periodic Table; C) A compound based on phosphorous; A) B) and C) being supported upon alumina or silica.

10. Process according to claim 9 wherein element A is molybdenum.

11. Process according to claim 10 wherein the catalyst includes molybdenum oxide in proportions ranging from 5 to 30% with respect to the total weight of the catalyst.

12. Process according to claim 9 wherein element B is nickel.

13. Process according to claim 12 wherein the catalyst includes nickel oxide in proportions of 5 to 30% with respect to total weight of the catalyst.

14. Process according to claim 1 wherein the feedstock is residues.

15. Process according to claim 1 wherein the feedstock is bitumens.

* * * * *